US006848774B2

(12) United States Patent
Shrivastava et al.

(10) Patent No.: US 6,848,774 B2
(45) Date of Patent: Feb. 1, 2005

(54) INK JET PRINTER DEFLECTION ELECTRODE ASSEMBLY HAVING A DIELECTRIC INSULATOR

(75) Inventors: Dilip K. Shrivastava, Lake Zurich, IL (US); Frank Eremity, Streamwood, IL (US); George Arway, Norridge, IL (US)

(73) Assignee: Videojet Technologies, Inc., Wood Dale, IL (US)

( * ) Notice: Subject to any disclaimer, the term of this patent is extended or adjusted under 35 U.S.C. 154(b) by 4 days.

(21) Appl. No.: 10/113,089

(22) Filed: Apr. 1, 2002

(65) Prior Publication Data

US 2003/0184620 A1 Oct. 2, 2003

(51) Int. Cl.[7] ..... B41J 2/09
(52) U.S. Cl. ..... 347/77
(58) Field of Search ..... 347/77, 76, 82, 347/75

(56) References Cited

U.S. PATENT DOCUMENTS

| | | | | | |
|---|---|---|---|---|---|
| 3,895,386 | A | | 7/1975 | Keur et al. | 347/77 |
| 4,075,636 | A | | 2/1978 | Galetto et al. | 347/53 |
| 4,122,458 | A | * | 10/1978 | Paranjpe | 347/77 |
| 4,138,688 | A | | 2/1979 | Heard et al. | 347/77 |
| 4,167,741 | A | | 9/1979 | Heard et al. | 347/77 |
| 4,246,589 | A | | 1/1981 | Denny et al. | 347/77 |
| 4,617,574 | A | | 10/1986 | Millet et al. | 347/49 |
| 4,638,325 | A | * | 1/1987 | Schneider et al. | 347/75 |
| 4,743,922 | A | | 5/1988 | Regnault et al. | 347/74 |
| 4,845,512 | A | * | 7/1989 | Arway | 347/77 |
| 4,928,113 | A | * | 5/1990 | Howell et al. | 347/76 |
| 5,434,609 | A | * | 7/1995 | Rhodes | 347/77 |

FOREIGN PATENT DOCUMENTS

| | | |
|---|---|---|
| JP | 55-091683 | 7/1980 |
| JP | 55-166258 | 12/1980 |
| JP | 56-105973 | 8/1981 |
| JP | 56-123872 | 9/1981 |
| JP | 56-146783 | 11/1981 |

OTHER PUBLICATIONS

"Ink Jet Deflection Plate Arrangement", West et al., IBM Technical Disclosure Bulletin, pp. 476–477, vol. 15, No. 2, Jul. 1972.

* cited by examiner

*Primary Examiner*—K. Feggins
(74) *Attorney, Agent, or Firm*—McAndrews, Held & Malloy, Ltd.

(57) ABSTRACT

According to certain aspects of an embodiment of the present invention, a deflection electrode assembly is provided for use in a continuous ink jet printer of the type which projects a stream of ink drops toward a substrate and controls placement of the ink drops on the substrate by selectively charging the individual ink drops and passing the charged ink drops through an electric (deflection) field created by the deflection electrode assembly. The deflection electrode assembly includes a high voltage deflection electrode and a low voltage deflection electrode positioned on opposite sides of the ink drop stream. A dielectric insulating member is mounted on at least one of the deflection electrodes. The insulating member include a longitudinal opening which exposes the deflection electrode along the path of the ink jet stream, thereby virtually eliminating the tendency for accumulated ink to decrease the strength of the deflection field. The insulating member extends inwardly and underlies the bottom face of the deflection electrode along at least its front and side edges. Providing insulation along the front and side edges of the deflection electrode reduces arcing between the deflection electrodes. Providing the longitudinal opening in the insulating member reduces the field distortion effects of micro-satellite ink drops that would otherwise accumulate on the insulating member.

17 Claims, 3 Drawing Sheets

INK JET PRINTER DEFLECTION ELECTRODE ASSEMBLY HAVING A DIELECTRIC INSULATOR

RELATED APPLICATIONS

[Not Applicable]

FEDERALLY SPONSORED RESEARCH OR DEVELOPMENT

[Not Applicable]

[MICROFICHE/COPYRIGHT REFERENCE]

[Not Applicable]

BACKGROUND OF THE INVENTION

The present invention relates to ink jet printing, and in particular to an improved deflection electrode assembly for a continuous ink jet printer.

Continuous ink jet printers are well known in the field of industrial coding and marking, and are widely used for printing information, such as expiry dates, on various types of substrate passing the printer on production lines. As shown in FIG. 1, a jet of ink is broken up into a regular stream of uniform ink drops by an oscillating piezoelectric element. The drops then pass a charging electrode where the individual drops are charged to selected voltages. The drops then pass through a transverse electric field (deflection field) provided across a pair of deflection electrodes. Each drop is deflected by an amount that depends on its respective charge. If a drop is uncharged, it will pass through the deflection electrodes without deflection. Uncharged and slightly charged drops are collected in a catcher and returned to the ink supply for reuse. A drop following a trajectory that misses the catcher will impinge on the substrate at a point determined by the charge on the drop. Often, each charged drop is interspersed by a guard drop with substantially no charge to decrease electrostatic and aerodynamic interaction between charged drops. As the substrate moves past the printer, the placement of the drop on the substrate in the direction of motion of the substrate will have a component determined by the time at which the drop is released. The direction of motion of the substrate will hereinafter be referred to as the horizontal direction, and the direction perpendicular to this, in the plane of the substrate will hereinafter be referred to as the vertical direction. These directions are unrelated to the orientation of the substrate and printer in space. If the drops are deflected vertically, the placement of a drop in the vertical and horizontal direction is determined both by the charge on the drop and the position of the substrate.

Better control over drop placement, and hence print quality, can be achieved by maintaining the highest possible deflection field strength at all times. In this respect, it is known to bend or angle the positive (high voltage) deflection electrode to generally conform the deflection electrode to the path of the charged drops. The strength of the deflection field can also be increased by moving the deflection electrodes closer together. However, moving the electrodes closer together increases the tendency for arcing between the deflection electrodes.

Control over drop placement can also be improved by minimizing the aerodynamic effects and the drop-to-drop charge interaction effects. Both are reduced by shortening the flight distance between the charging electrode and the substrate. However, moving deflection electrodes too close to the charging electrode increases the likelihood of arcing between the high voltage deflection electrode and the charging electrode.

In order to reduce arcing, it is known to provide insulating material on the high voltage deflection electrode, and in some instances additionally on the low voltage deflection electrode. Certain inks, including pigmented inks, have a tendency to create micro-satellite drops. It has been found that the micro-satellite drops tend to accumulate on the insulating material. The accumulation of the charged micro-satellite drops on the insulating material decreases the strength of the deflection field, thereby decreasing drop deflection and print quality. When this occurs, the printer must be shut down so the ink build up can be removed from the insulating material. As will be appreciated, the need to shut down the printer is highly undesirable in many applications.

BRIEF SUMMARY OF THE INVENTION

According to certain aspects of an embodiment of the present invention, a deflection electrode assembly is provided for use in a continuous ink jet printer of the type which projects a stream of ink drops toward a substrate and controls placement of the ink drops on the substrate by selectively charging the individual ink drops and passing the charged ink drops through an electric field created by the deflection electrode assembly. The deflection electrode assembly includes a pair of deflection electrodes positioned on opposite sides of the ink jet stream. A dielectric insulating material is disposed on at least one of the deflection electrodes to reduce arcing between the electrodes. For example, when the drops are negatively charged, the electrodes can include a high voltage electrode having a high, positive potential and low voltage electrode which is grounded. In this configuration, the insulating material is disposed on at least the high voltage electrode. The insulating material includes a longitudinal opening which exposes the deflection electrode along the path of the ink drop stream. As a result, the micro-satellite drops accumulate on the deflection electrode, as opposed to on the insulating material. The micro-satellite drops discharge, i.e., lose their electrical charge, when they impact the deflection electrode. Because the accumulated micro-satellite drops discharge on the deflection electrode, their deleterious effect on the strength of the deflection field is significantly reduced. The insulating member extends inwardly and underlies the inner face of the deflection electrode along at least its front and side edges.

The foregoing summary, as well as the following detailed description of the preferred embodiments of the present invention, will be better understood when read in conjunction with the appended drawings. For the purpose of illustrating the preferred embodiments of the present invention, the drawings depict embodiments that are presently preferred. It should be understood, however, that the present invention is not limited to the arrangements and instrumentality shown in the attached drawings.

DETAILED DESCRIPTION OF THE INVENTION

Figure 1:
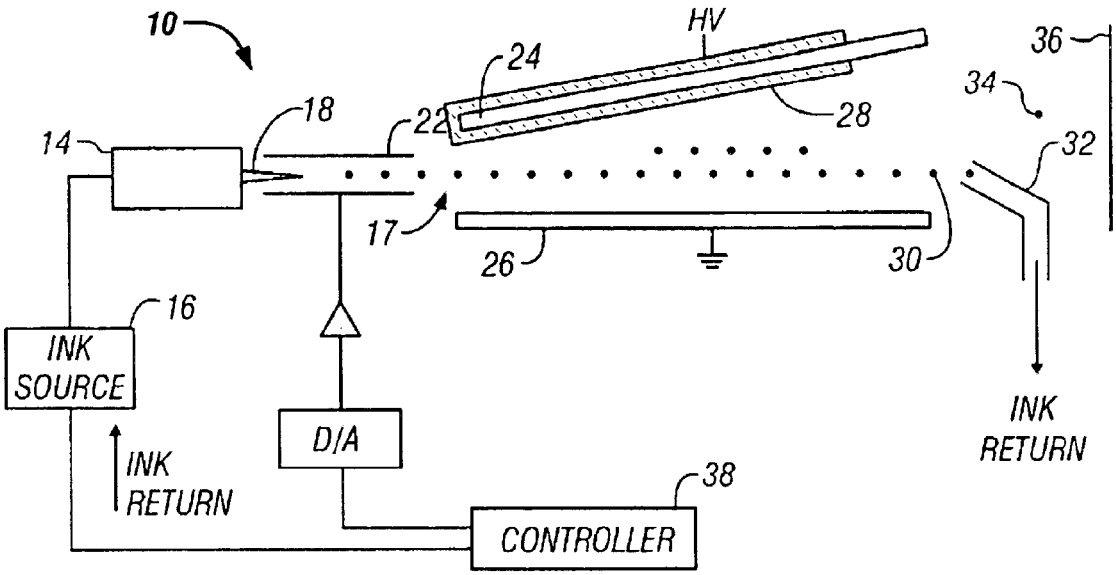
FIG. 1 (Prior Art)
FIG. 1 shows the operation of a typical continuous ink jet printer.

FIG. 1 illustrates a conventional continuous ink jet printer 10. The ink jet printer 10 includes a print head with a drop generator 14 connected to receive ink from an ink source 16. The drop generator 14 incorporates a piezoelectric oscillator which creates perturbations in the ink flow at a nozzle 18. The nozzle emits stream 17 of uniformly sized and spaced drops. The drops pass through a charging tunnel 22, where a different charge can be applied to each drop. The drops subsequently pass between a pair of opposed deflection electrodes 24, 26. A power source (not shown) is connected to the deflection electrodes 24, 26 such that a relatively uniform electric field extends between the electrodes. The charge on a given drop will determine the amount it deflects vertically as it passes between the deflection electrodes 24, 26. Insulation 28 is disposed on at least one of the deflection electrodes 24, 26 to prevent arcing between the deflection electrodes 24, 26, and also between the deflection electrodes and the charging tunnel 22.

Uncharged or slightly charged drops 30 pass substantially undeflected to a catcher 32, and are recycled to ink source 16. Charged drops 34 are projected toward a substrate 36 and are deflected so as to have a trajectory striking the substrate as the substrate moves past the print head in the horizontal direction. The level of charge applied to the drop controls its vertical displacement/position on the substrate 36.

The charge to be applied to a drop is determined by a controller 38, which may be implemented by a device such as a general purpose processor, microcontroller, or embedded controller having appropriate input and output circuitry, as is well known in the art. The controller 38 operates under general program control of the instructions stored in an associated memory. The controller 38 is programmed to deliver control signals to the charge tunnel 22 to control the charges applied to the individual drops as they pass through the charge tunnel 22. The operation of such ink jet printers is well known in the art and, hence, will not be explained in greater detail herein.

Referring to FIGS. 2–8, a deflection electrode assembly 40 (or, also referred to as simply the electrode assembly 40) according to certain aspects of a specific embodiment of the present invention will be described in greater detail. The electrode assembly 40 is configured for use with a conventional ink jet printer, such as the printer 10 described above in FIG. 1. The electrode assembly 40 is used instead of the deflection electrodes 24, 26 shown in FIG. 1. The electrode assembly 40 is interposed between the charging tunnel 22 and the substrate 36, along the drop stream 17. In the illustrated embodiment, the deflection assembly 40 includes a high voltage deflection electrode 42, a low voltage (or ground) deflection electrode 44, and dielectric insulating material in the form of an insulating member 46. A power source (not shown) is connected to the deflection electrodes 42, 44 to create a deflection field between the electrodes so that the drops are vertically deflected in relation to their individual charges. For ease of reference herein, the deflection electrodes 42, 44 may be referred to as the high voltage deflection electrode 42 and the low voltage deflection electrode 44, or simply as the high voltage electrode 42 and the low voltage electrode 44.

The low voltage deflection electrode 44 includes a generally planar deflection plate 48 positioned below the drop stream 17, at a location between the charging tunnel 22 and the substrate 36. The low voltage deflection electrode 44 may also include a mounting portion, not shown, for securing the low voltage deflection electrode 44 to the frame (not shown) of the printer 10 or another mounting structure.

The high voltage deflection electrode 42 includes a deflection plate 50 and a mounting bracket 52. The mounting bracket 52 presents mounting apertures 54 so that the electrode 42 can be secured to the frame 53 of the printer 10 or another mounting structure by fasteners (not shown). (See FIG. 3). Insulating material 55 is interposed between the bracket 52 and the frame 53 to prevent grounding of the high voltage deflection electrode 42.

Figure 2:
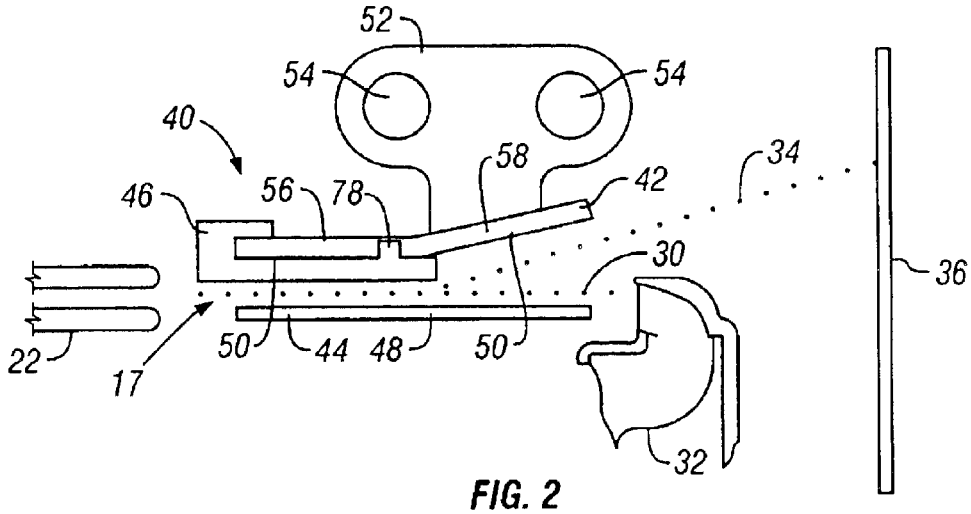
FIG. 2 illustrates certain aspects of a deflection electrode assembly according to a specific embodiment of the present invention.

The deflection plate 50 of the high voltage deflection electrode 42 extends along the ink drop stream 17 at a location opposite the deflection plate 48 of the low voltage deflection electrode 44. The deflection plate 50 includes a front portion 56 and a rear portion 58. The front portion 56 extends generally parallel to the deflection plate 48 of the low voltage deflection electrode 44, whereas the rear portion 58 angles upwardly, as shown in FIG. 2, to generally conform to the path of the charged drops.

In the illustrated embodiment, the ink drops are negatively charged, the high voltage deflection electrode 42 is maintained at a relatively high positive voltage potential, and the low voltage deflection electrode 44 is grounded. As a result, the negatively charged drops are deflected towards the high voltage deflection electrode 42 as they pass between the electrodes 42, 44.

Insulating material is disposed on at least one of the deflection electrodes 42, 44. In the above arrangement, the insulating material is disposed on at least the high voltage electrode 42. It will be appreciated, however, that the insulating material can be positioned on either or both of the deflection electrodes 42, 44, depending on the polarity of the electrodes 42, 44 and the polarity of the charged drops. For example, negatively charged drops can be passed between a grounded deflection electrode and a deflection electrode with a high negative voltage potential. In such a configuration, the drops are pushed (repelled) away from the negative electrode and towards the ground electrode. In such a configuration, the insulating material is disposed on at least the high voltage (negative) electrode. Alternatively, positively charged drops can be passed between a deflection electrode with a high positive voltage potential and a grounded electrode. In this configuration, the positively charged drops are repelled from the high voltage (positive) electrode. In this configuration, the insulating material is disposed on at least the high voltage (positive) electrode. As still another alternative, positively charged drops can be passed between a grounded deflection electrode and an electrode maintained at a high negative voltage potential. In this configuration the insulating material is disposed on at least the high voltage (negative) deflection electrode.

Figure 3:
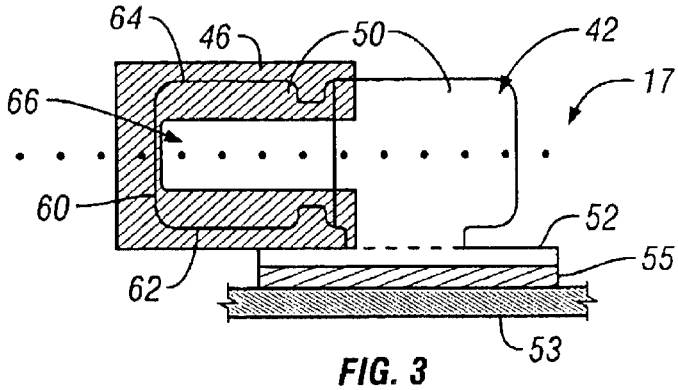
FIG. 3 illustrates a bottom view of a high voltage deflection electrode and an insulating member from the assembly of FIG. 2.

In the illustrated embodiment, the insulating material is in the form of an insulating member 46 that is mounted on the high voltage electrode 42. Alternatively, the insulating material could be molded or sprayed onto the deflection electrode 42. The insulating member 46 is mounted on the front portion 56 of the high voltage deflection plate 50. As can be seen in FIG. 3, the insulating member 46 extends along the front edge 60 and side edges 62, 64 of the front portion 56 of the deflection plate 50. The insulating member 46 extends inwardly beyond the edges of the deflection plate 50 and overlaps the front and side edges 60–64 of the deflection plate 50. Because the insulating member 46 overlaps the edges 60–64 of the deflection plate 50, the tendency for arcing to occur between the deflection electrodes 42, 44 is greatly reduced. Similarly, the insulating material along the front edge 60 of the deflection plate 50 greatly reduces the tendency for arcing between the high voltage deflection electrode 42 and the charging electrode 22 when these electrodes are placed in close proximity to one another.

The insulating member 46 includes a longitudinal opening or void 66, which exposes the deflection plate 50 along the ink drop stream 17. In the illustrated embodiment, the longitudinal opening 66 is in the form of a generally rectangular slot, but, as will be appreciated, the opening can assume other configurations without departing from the scope of the present invention. Removing the insulating material along the path of the ink drop stream 17 virtually eliminates the deleterious effect that the accumulated micro-satellite drops have on the deflection field. This is because the micro-satellite drops discharge, i.e., lose their electrical charge, as they accumulate on the electrode 42. Additionally, testing indicates that ink accumulation is reduced when the longitudinal slot 66 is employed. The longitudinal slot 66 may be on the order of 0.12 inches wide and it extends along substantially the entire length of the front portion 56 of the deflection plate 50. In this respect, the amount of overlap between the insulating member 46 and the front edge 60 of the deflection plate 50 is minimal, so that the deflection plate 50 is exposed along substantially its entire length. For example, the overlap along the front edge 60 of the deflection plate 50 may be on the order of 0.010 inches.

Figure 5:
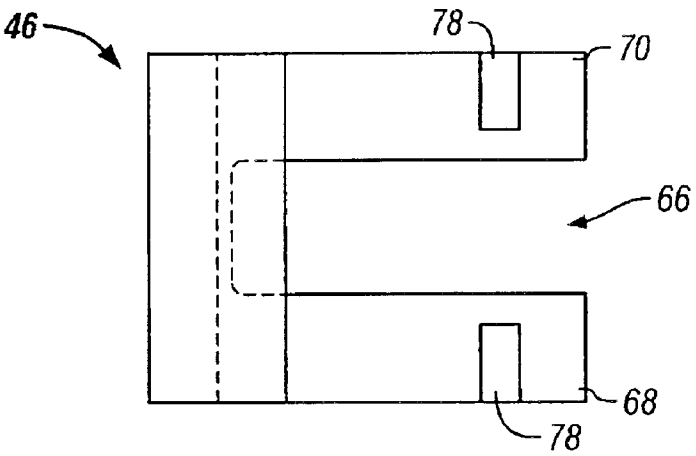
FIG. 5 is a top view of the insulating member of FIG. 3.
Figure 7:
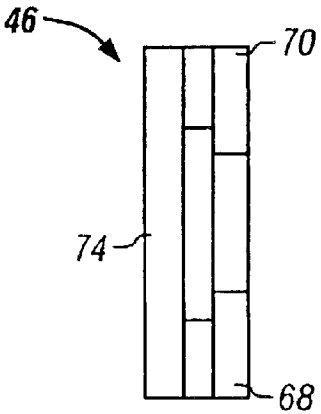
FIG. 7 is an end view of the insulating member of FIG. 3.
Figure 4:
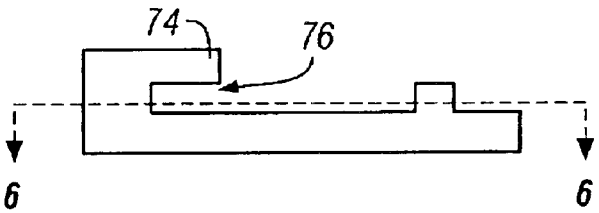
FIG. 4 is a side view of an insulating member of FIG. 3.
Figure 6:
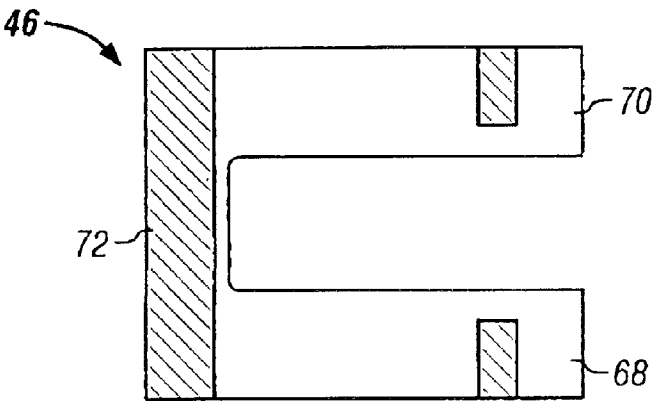
FIG. 6 is a cross-sectional view along line A—A of FIG. 4.
Figure 10:
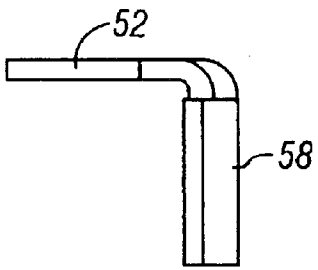
FIG. 10 is an end view of the high voltage deflection electrode of FIG. 3.
Figure 9:
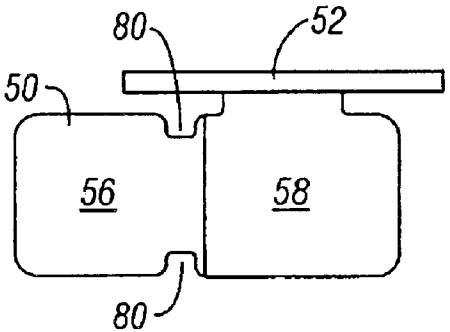
FIG. 9 is a top view of the high voltage deflection electrode of FIG. 3.
Figure 8:
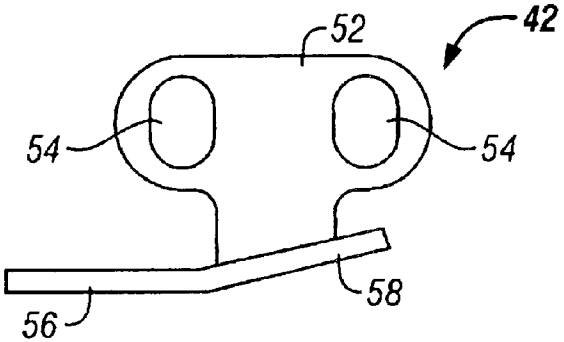
FIG. 8 is a side elevation view of the high voltage deflection electrode of FIG. 3.

Referring to FIGS. 4–6, the insulating member 46 includes a lower portion consisting of a pair of laterally spaced bottom legs 68, 70. A front cross member 72 extends laterally between the bottom legs 68, 70. The longitudinal opening 66 is defined by the space between the legs 68, 70. A top wall 74 extends from the top of the cross member 72 in a plane generally parallel to that of the bottom legs 68, 70. The top wall 74 and bottom legs 68, 70 define a lateral slot 76 that is sized to receive the front of the deflection plate 50. Locking tabs 78, which extend upwardly from the lower legs 68, 70, mate with reciprocal slots 80 (FIG. 9) formed in the deflection plate 50 to secure the insulating member 46 to the deflection plate 50. The locking tabs 78 and the slots 80 cooperate such that the insulating member 46 snap-fits onto the high voltage deflection electrode 42. Alternatively, the insulating member 46 can be secured to the deflection electrode 42 by adhesive, an interference fit, a suitable fastener, or any other suitable means. Moreover, as was mentioned above, in some applications the insulating material can be sprayed or otherwise molded onto the deflection electrode 42.

The insulating member 46 is formed from a suitable dielectric material such as plastic. One suitable plastic is Delrin® acetal resin, as is commercially available from E.I. du Pont de Nemours and Company. In production, the insulating member 46 may be formed by any suitable manufacturing process, including machining, molding or extruding. The insulating member 46 functions to reduce arcing between the electrodes when the electrodes are placed in close proximity to one another. However, because there is no insulating material along the path of the ink drop stream 17, the tendency for the accumulated micro-satellites to adversely effect the strength of the deflection field is virtually eliminated. This is because the micro-satellite drops accumulate on the high voltage deflection plate 50, where they discharge. As a result, there is less of a decrease in the field strength of the deflection field than occurs when the charged micro-satellite drops accumulate directly on the deflection electrode's insulator, as occurs in the prior art design.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A deflection electrode assembly for use in a continuous ink jet printer of the type which projects a stream of ink drops toward a substrate and controls placement of the ink drops on the substrate by selectively charging the individual ink drops and passing the charged ink drops through an electric field created by the deflection electrode assembly, the deflection electrode assembly comprising:

a high voltage deflection electrode positioned along the ink drop stream;

a low voltage deflection electrode positioned along the ink drop stream, opposite the high voltage deflection electrode; and a insulating material disposed on at least one of the deflection electrodes, the insulating material including a longitudinal opening which exposes the deflection electrode along the path of the ink drop stream, wherein the longitudinal opening comprises a generally rectangular slot formed in the insulating material.

2. An electrode assembly as set forth in claim 1, wherein the insulating material comprises an insulating member mounted on one of the deflection electrodes.

3. An electrode assembly as set forth in claim 2, wherein the insulating member is mounted on the high voltage deflection electrode.

4. A deflection electrode assembly as set forth in claim 3, wherein the high voltage electrode includes a deflection plate having a front edge and a pair of opposed side edges and an inner face which faces the ink drop stream, and wherein the insulating member extends inwardly of the front and side edges and is disposed on the inner face of the deflection plate.

5. A deflection electrode assembly as set forth in claim 2, wherein the insulating member is configured to snap fit onto the deflection electrode.

6. A deflection electrode assembly as set forth in claim 1, wherein the insulating material is formed from plastic.

7. An insulator for use in a continuous ink jet printer of the type which projects a stream of ink drops toward a substrate and controls placement of the ink drops on the substrate by selectively charging the individual ink drops and passing the charged ink drops through an electric field created by a pair of laterally spaced deflection electrodes, the insulator comprising:

a insulating material disposed on at least one of the deflection electrodes so as to reduce arcing between the deflection electrodes, the insulating material defining a longitudinal opening which exposes the deflection electrode along the path of the ink jet stream, wherein one of the deflection electrodes includes a deflection plate having a front edge and a pair of opposed side edges and an inner face which faces the ink jet stream, and wherein the insulating material extends inwardly of the front and side edges and is disposed on the inner face of the deflection plate.

8. An insulator as set forth in claim 7, wherein the deflection electrodes comprise a high voltage deflection electrode and a low voltage deflection electrode, and wherein the insulating material is disposed on the high voltage deflection electrode.

9. An insulator as set forth in claim 7, wherein the insulating material comprises an insulating member mounted on one of the deflection electrodes.

10. An insulator as set forth in claim 9, wherein the insulating member is configured to snap fit onto one of deflection electrodes.

11. An insulator as set forth in claim 9, wherein the insulating member is formed from plastic.

12. A method for preventing arcing between a pair of deflection electrodes in a continuous ink jet printer of the type which projects a stream of ink drops toward a substrate and controls placement of the ink drops on the substrate by selectively charging the individual ink drops and passing the charged ink drops through an electric field created by the deflection electrodes, the method comprising:

positioning dielectric insulation on at least one of the deflection electrodes to reduce arcing between the deflection electrodes; and providing a slot in the dielectric insulation along the ink drop stream to reduce the effect of ink accumulation on the electric field.

13. A method as set forth in claim 12, wherein the insulation is formed from plastic.

14. A deflection electrode assembly for use in a continuous ink jet printer of the type which projects a stream of ink drops toward a substrate and controls placement of the ink drops on the substrate by selectively charging the individual ink drops and passing the charged ink drops through an electric field created by the deflection electrode assembly, the deflection electrode assembly comprising:

a high voltage deflection electrode positioned along the ink drop stream;

a low voltage deflection electrode positioned along the ink drop stream, opposite the high voltage electrode; and an insulating material disposed on a surface of one of the deflection electrodes which faces the other of the deflection electrodes, the insulating material including a slot which exposes a portion of the surface of the deflection electrode along the path of the ink drop stream.

15. A deflection electrode assembly for use in a continuous ink jet printer of the type which projects a stream of ink drops toward a substrate and controls placement of the ink drops on the substrate by selectively charging the individual ink drops and passing the charged ink drops through an electric field created by the deflection electrode assembly, the deflection electrode assembly comprising:

a high voltage deflection electrode positioned along the ink drop stream;

a low voltage deflection electrode positioned along the ink drop stream, opposite the high voltage electrode; and an insulating material disposed on a surface of one of the electrodes such that the insulating material is interposed between the electrode and the ink drop stream, the insulating material including a slot which extends parallel to the ink drop stream.

16. A deflection electrode assembly for use in a continuous ink jet printer of the type which projects a stream of ink drops toward a substrate and controls placement of the ink drops on the substrate by selectively charging the individual ink drops and passing the charged ink drops through an electric field created by the deflection electrode assembly, the deflection electrode assembly comprising:

at least one deflection electrode, and an insulating member being configured to snap fit onto said at least one deflection electrode.

17. A deflection electrode assembly for use in a continuous ink jet printer of the type which projects a stream of ink drops toward a substrate and controls placement of the ink drops on the substrate by selectively charging the individual ink drops and passing the charged ink drops through an electric field created by the deflection electrode assembly, the deflection electrode assembly comprising:

at least one deflection electrode includes a deflection plate having a front edge and a pair of opposed side edges and an inner face which faces the stream of ink drops; and an insulating material extending inwardly of said front and side edges and being disposed on said inner face of said deflection plate.

* * * * *